US005297639A

United States Patent [19]

Schneider et al.

[11] Patent Number: 5,297,639

[45] Date of Patent: Mar. 29, 1994

[54] METHOD AND APPARATUS FOR USING MULTIPLE JETS

[76] Inventors: Francine Schneider, 10, Rue des Poiriers, F-67340 Ingwiller; Patrick Loegel, 8, Chemin du Zollstock, F-67340 Lichtenberg; Sylvie Reichert, 115, Rue du Gal Goureau; Isabelle Durr, 1a, Rue des Poiriers, both of F-67340 Ingwiller; Charles Loegel, 7, Rue des Cochers, F-67340 Lichtenberg, all of France

[21] Appl. No.: 928,519

[22] Filed: Aug. 11, 1992

[30] Foreign Application Priority Data

Aug. 27, 1991 [DE] Fed. Rep. of Germany ..... 4128422

[51] Int. Cl.[5] ..... E21B 7/18

[52] U.S. Cl. ..... 175/65; 175/67; 175/424

[58] Field of Search ..... 175/65, 67, 339, 340, 175/424

[56] References Cited

U.S. PATENT DOCUMENTS 4,221,271 9/1980 Barker ..... 175/424
4,534,427 8/1985 Wang et al. ..... 175/67
4,688,650 8/1987 Hayadavoudi et al. ..... 175/65 X
4,708,214 11/1987 Krawza et al. ..... 175/424
4,852,668 8/1989 Dickinson, III et al. ..... 175/67
4,930,586 6/1990 Turin et al. ..... 175/67 X

FOREIGN PATENT DOCUMENTS 3610015 8/1988 Fed. Rep. of Germany .

OTHER PUBLICATIONS

German Journal "s+t" 42 (1988), vol. 1, p. 30 (Aus der Industrie, Magazin).

*Primary Examiner*—Thuy M. Bui
*Attorney, Agent, or Firm*—Hopgood, Calimafde, Kalil, Blaustein & Judlowe

[57] ABSTRACT

A method of erosive cutting of a hard material such as rock utilizes two spaced clusters of jets for high-pressure discharge of fluid in the course of their movement along the same longitudinal path over the hard material. One of the jet clusters has a fixed orientation for multiple-jet discharge at the hard material, while the other cluster of jets is subjected to oscillating excursions transverse to the direction of the path that both clusters are caused to follow. A cooling medium is directed at the working site between the two clusters. The result is a faster working rate and a more cleanly defined groove in the hard material, along the path of movement.

20 Claims, 3 Drawing Sheets

METHOD AND APPARATUS FOR USING MULTIPLE JETS

BACKGROUND OF THE INVENTION

The present invention is directed to a method of and to apparatus for cutting, drilling and similar erosive working of a rock, ore, coal, concrete or other hard object, using multiple-jet discharges of a pressure-fluid medium.

Methods and apparatus of the character indicated are known from German patents 3,739,825 and 3,915,933. In this connection, it is also known from German patents 3,410,981 and 3,516,572 to provide nozzle heads with a plurality of nozzles. And it is further known from German patents 3,422,311 and 2,607,097 to mount nozzle heads so as to enable them to be pivoted on a crankshaft.

The above-mentioned methods and apparatus have already proven their worth since it is possible thereby also to work elongate and narrow slots, boreholes and similar holes, for instance from hard rock, and the known apparatus is of relatively narrow and elongate configuration.

BRIEF STATEMENT OF THE INVENTION

It is an object of the invention to provide simple means to further improve the operability of methods and apparatus of the character indicated.

It is a specific object to meet the above object by realizing greater working efficiencies even in the case of very hard rock, including particularly hard crystal grains.

A further object is to achieve the above objects with apparatus which operates with minimum wear.

And it is a still further object to increase the speed with which a slot of a given width, length and height can be formed in a hard material of the character indicated, while working costs are reduced.

The invention achieves these objects by providing two clusters of high-pressure jets in spaced relation such that one cluster precedes the other in a single direction of movement over the material to be cut, and by oscillating one to the exclusion of the other cluster in a direction generally transverse to the single direction of movement.

Experiments have shown that the invention enables an increase in the working efficiency of up to about 100% depending upon the kind of object to be worked and depending upon the pressure media and, if applicable, the coolants employed. The apparatus exhibits little wear even when working in deep slots.

DETAILED DESCRIPTION

The invention will be described in detail in conjunction with the accompanying drawings, in which:

FIG. 1*a* is a view in cross-section, in the transverse direction QR of a working displacement, the direction QR being identified by arrows in FIG. 2, and the section being through a slot 16 being formed in rock, in the vicinity of a divergent cluster of jets from a first nozzle head 3*a*;

FIG. 1*b* is a corresponding cross-section in the vicinity of a nozzle head 3*b* which follows at a distance AB the working displacement of the first nozzle head 3*a*; the distance AB being identified in FIG. 2;

Figure 1A:
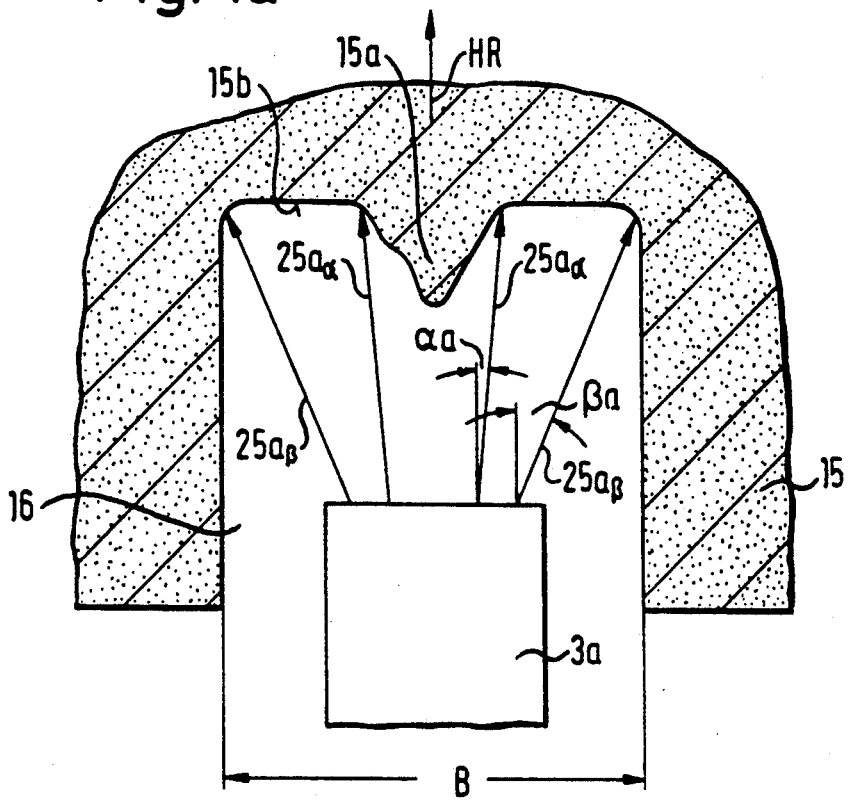
Figure 2:
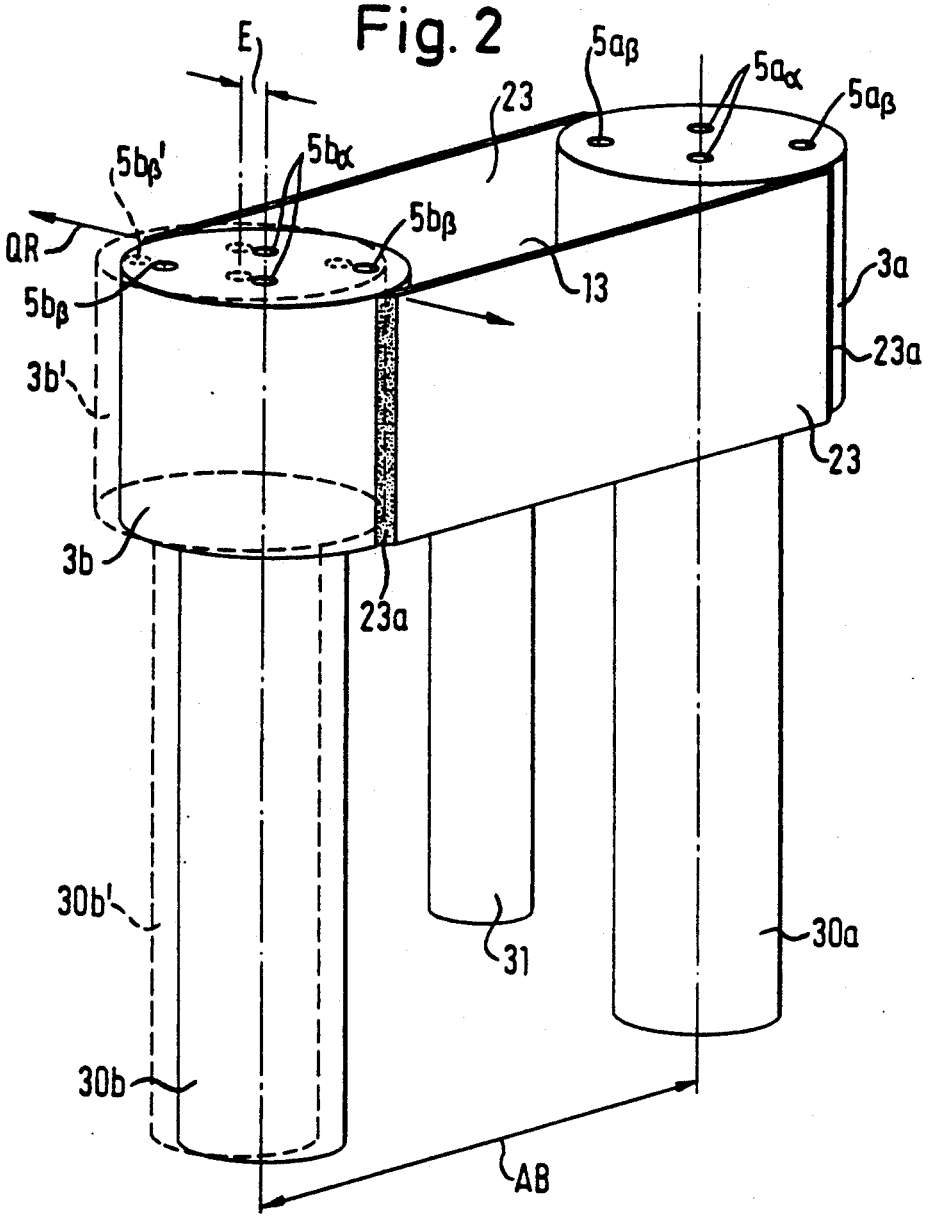
FIG. 2 is a schematic perspective view of an assembly comprising two nozzle heads 3*a*, 3*b* and supply conduits 30*a*, 30*b*, 31 leading to the assembly.

As illustrated in FIGS. 1*a* and 2, pressure medium jets 25*aα*, 25*aβ* are emitted from the nozzles 5*aα*, 5*aβ* of the nozzle head 3*a*. In the instant example water is used as the pressure medium which is maintained at a pressure of, particularly, between 800 and 3000 bar such as, for example, 2400 bar. While the central nozzles 5*aα* are oriented at an angle αa of incidence of about 5° to the main jet direction HR, the angle βa of incidence of the more spread-out jets 25*aβ* amounts up to 27°, suitably 17°. These outer jets 25*aβ* determine the width B of the slot 16 to be cut from rock or from an object 15. It has been found that in some cases of working, formations 15*a* having pin-like cross-section will remain at the bottom 15*b* of the slot 16. This will sometimes be a case of abutting interference with the nozzle head 3*a* as it is moved in the penetrating direction HR in order to deepen the slot 16.

Figure 1B:
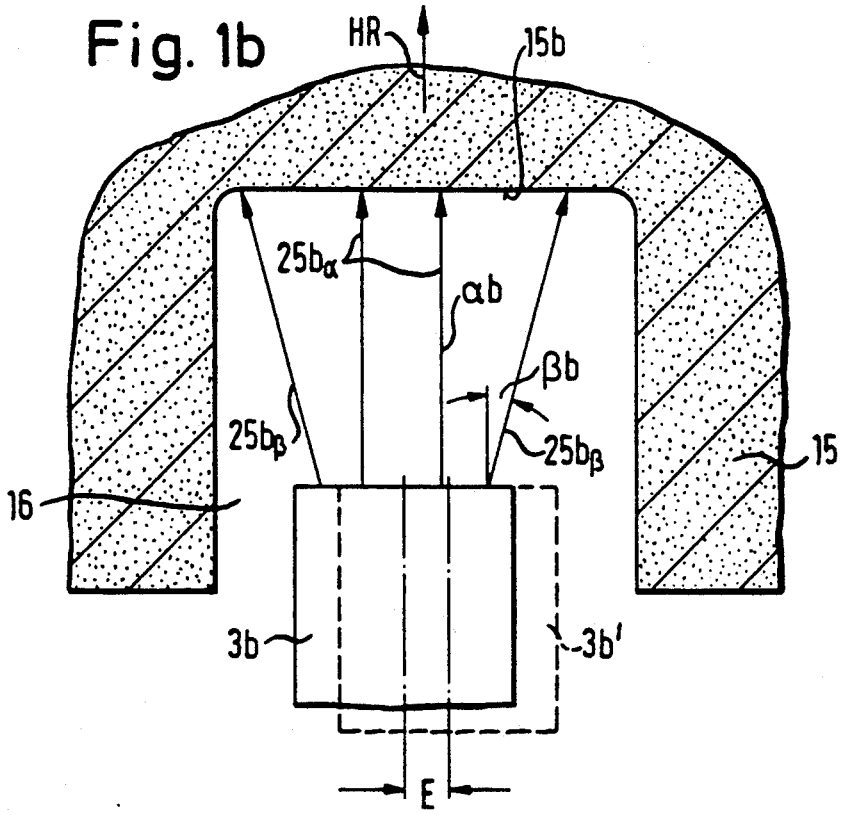

In accordance with the present invention, a further nozzle head 3*b* is provided to follow the nozzle head 3*a* as illustrated in FIG. 1*b*. Said nozzle head 3*b* differs as follows from the nozzle head 3*a* and from the way of guiding the same.

The central jets 25*bα* are at an angle αβ of incidence to the main jet direction HR of about 0° while the lateral jets 25*bβ* of pressure medium are oriented at an angle βb of incidence of about 11° to the main jet direction HR. This results in a smaller spreading angle than in the case of the outer jets 25*aβ* of the first nozzle head 3*a* which determine the width B of the slot. Moreover, it is provided in accordance with the invention that the nozzle head 3*b* - as indicated by the dashed lines and by reference numeral 3' - is deflected and oscillated by a deflecting amount E in the transverse direction QR (i.e., in the drawing plane of FIG. 1*b*). The oscillating movement occurs at a frequency of between about 10 and 250 Hz. In the present embodiment the deflection E amounts to 4 mm with a distance AB of about 60 mm between the axes of the nozzle heads 3*a*, 3*b*. Surprisingly, it has been found that the use of a bundle of jets in the vicinity of the pin-like formation 15*a* will not alone result in rapid removal thereof; rather, it is the reciprocating whipping motion of the jets 25*bα*, 25*bβ* that results in a synergistic effect towards achieving the specified objective, which effect was completely unexpected.

Although previously known methods have permitted a working speed of about 2 m/h in porphyry, the method according to the present invention permits doubling of this speed to about 4 m/h. The consumption of water as the pressure medium amounts to about 50 l/min (liters per minute) when supplied through the feed conduits 30*a*, 30*b* to the two nozzle heads 3*a*, 3*b* and emitted therefrom through the eight nozzles 5*a*, 5*b* thereof.

Figure 5:
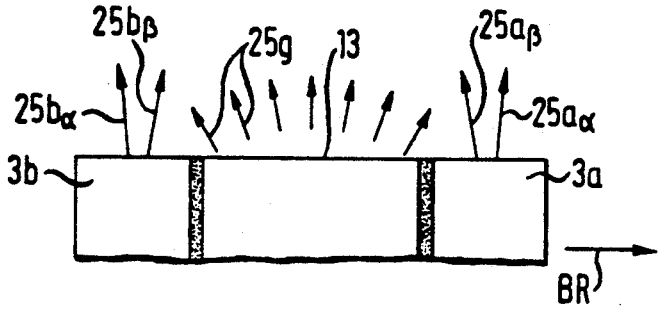
FIG. 5 is a fragmentary and schematic plan view in the transverse direction QR, showing the top portion of the assembly formed by the two nozzle heads 3*a*, 3*b*.

In FIG. 2 it is schematically indicated that the first nozzle head 3*a* with its supply conduit 30*a* is not moved in the transverse direction QR while the second, in particular the following nozzle head 3b with its supply conduit 30b, is rapidly moved to and fro by a deflecting amount E in the transverse direction QR, as indicated by 3b', 5bβ' and 30b'. The two nozzle heads 3a and 3b are interconnected by means of plates 23 such that each of the plates 23 is welded to the outer sides of the cylindrical nozzle heads 3a, 3b at the weld joints 23a so that a chamber 13 is defined between said plates and the nozzle heads 3a, 3b which is closed at the bottom (not visible in the figure) by another cross plate having the coolant conduit 31 fitted therein, said coolant then flowing out through the open-topped chamber 13 substantially in the main jet direction HR but preferably in the form of the bundle of jets 25g illustrated in FIG. 5 intermediate the jets 25a from the first nozzle head 3a and the jets 25b of pressure medium from the second nozzle head 3b. Air is a satisfactory coolant, the air being at a pressure between about 1 bar and 10 bar. The coolant of the coolant jets 25g is cooler by some 10° C., particularly by about 50° C., than the pressure medium exiting from the nozzles 5a, 5b.

Figure 3:
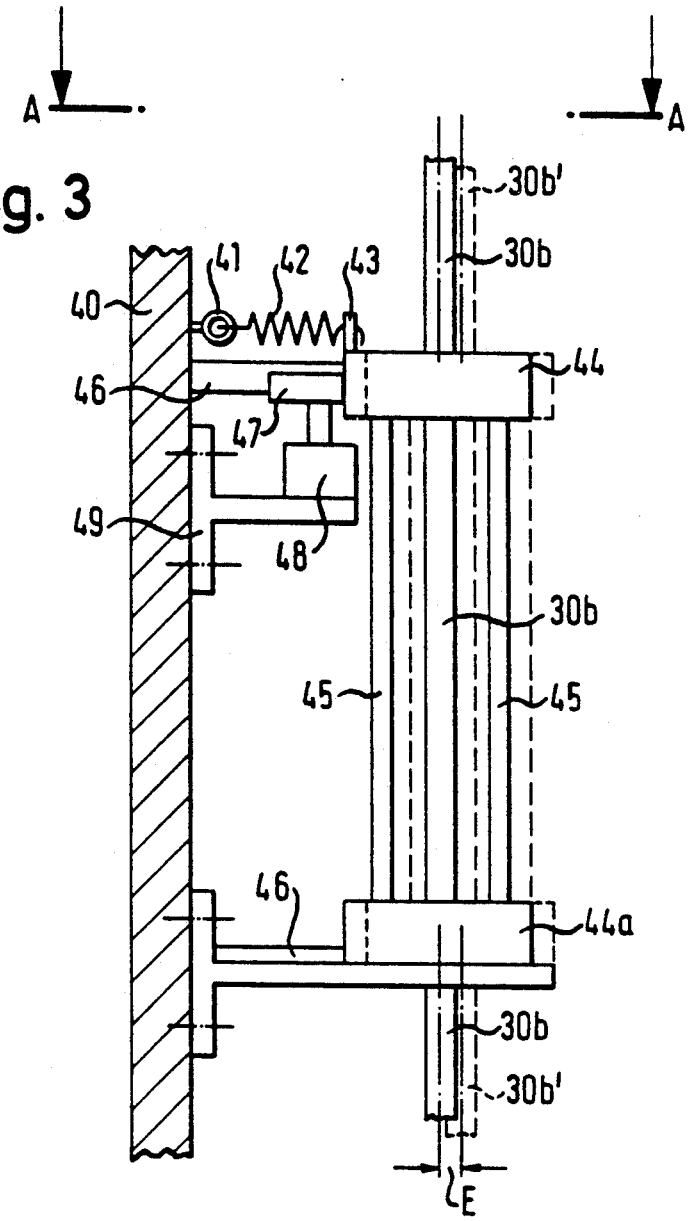
FIG. 3 is a schematic side view in the direction of movement BR showing a portion of the supply conduits 30*b* in the vicinity of the guide means therefor; the direction BR being identified in FIG. 5.
Figure 4:
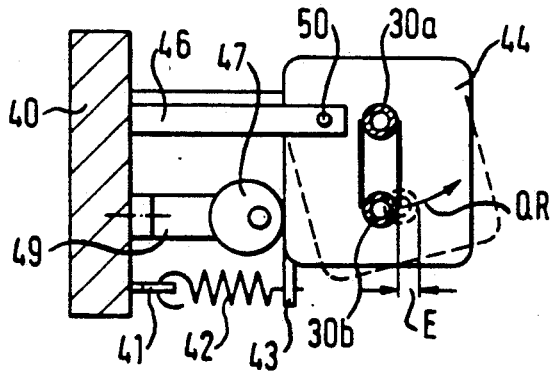
FIG. 4 is a schematic plan view from the aspect A—A of FIG. 3.

FIGS. 3 and 4 illustrate schematically an embodiment for the deflection E of the supply conduit 30b or the respective nozzle head 3b: each of the two supply conduits 30a and 30b is guided in respective guide or holding means 44, 44a which are held in spaced relationship by welded connecting bars 45 so that said holding means constitutes a substantially rigid assembly. Whereas the lower holding means 44a is mounted in a support rail 46 secured to a frame plate or similar component 40, a tension spring 42 having one end in engagement with component 40 via an eyelet 41 and the other end in engagement with the upper holding means 44 via a retaining pin 43 urges said holding means 44 against an eccentric cam 47 which is mounted on a bracket 49 through a driving unit 48 such as an electric motor, a hydraulic motor or a pneumatic motor, said bracket being likewise secured to the holding member or similar component 40. While the portion of the holding means 44 facing the supply conduit 30a for the nozzle head 3a is coupled to a journal 50 of a support member 46 mounted on the holding component 40, the eccentric cam 47 upon rotation pushes the other portion of the holding means 44, which faces the other supply conduit 30b, towards the right in FIG. 4 by the deflection amount E (dashed lines) whereby the reciprocating motion in the transverse direction QR also causes the corresponding nozzle head 3b and the respective jets 25bα, 25bβ to move correspondingly. It is believed that a kind of "hammer effect" is exerted on any pin-like or other formations 15a existing at the slot bottom 15b so that the slot bottom 15b may be cut substantially to provide a flat shape as shown in FIG. 1b.

In operation the second nozzle head 3b rocks about an angle of for instance 4° about the first nozzle head which is advanced along a path, especially a linear path, in the direction of movement BR and clears narrow slots 16 without much waste material.

The deflection E may also be achieved by the action of a percussion piston as in the case of pneumatic or compressed-air hammers.

The invention is especially suitable for reduced-vibration removal of rock or other hard underground material when for instance in large cities the foundations of new buildings are to be placed deeply in the ground without vibrations and damage to neighbouring buildings resulting therefrom. The working, i.e. clearing of slots is not only performed accurately and rapidly but also avoids any blasting of rock and/or the use of compressed-air hammers. In this respect, the instant invention also has a favourable environmental effect on account of the reduction of noise.

We claim:

1. The method of erosively working a hard object, as of rock, ore, coal, concrete or the like, by means of a pressure medium which is delivered in the form of plural jets, directed toward the object at different angles of incidence, the delivery being with high pressure of the medium on the object and advanced in one direction along a predetermined path, said method comprising the steps of:

providing two clusters of such jets in spaced relation such that one cluster precedes the other in the said one direction of movement; and oscillating one to the exclusion of the other of said clusters in a direction generally transverse to the said one direction of movement.

2. The method of claim 1, in which coolant under pressure is discharged at both said clusters from the space between said clusters.

3. The method of claim 1, in which coolant under pressure is discharged at the object from the space between said clusters.

4. The method of claim 1, in which the oscillating frequency of transverse displacement of said one cluster is between 10 and 250 Hz.

5. The method of claim 1, in which the pressure medium is delivered at a pressure within the range 800 to 3000 bar.

6. The method of claim 1, in which water is the pressure medium.

7. The method of claim 1, in which the spread of angles of incidence from the jets of one cluster is greater than the spread of angles of incidence from the other cluster.

8. The method of claim 7, in which the spread of angles of incidence from the oscillated cluster is less than the spread of angles of incidence from the other cluster.

9. The method of claim 8, in which the oscillating cluster trails the other cluster in said one direction of movement.

10. The method of claim 1, including the following additional steps:

traversing said clusters between predetermined limits along said path; and repeating the said traverse for such plurality of traverses as accomplishes a predetermined depth of erosive cut into the object.

11. The method of claim 10, wherein the rate of traverse displacement is but a fraction of the rate of oscillating displacement.

12. Apparatus for erosively working a hard object, as of rock, ore, coal, concrete or the like, comprising two heads having clusters of nozzles for directed jet discharge toward the object at different angles of incidence, means rigidly connecting said heads in spaced relation, with a separate pressure-fluid supply conduit to each head, frame means adapted for support of said heads and for their guidance in a working direction of displacement along a predetermined path wherein one of the heads follows the other along said path, means pivotally mounting said conduits and said heads in spaced parallel relation with a pivot-axis connection to said frame means such that one to the substantial exclusion of the other of said heads and its conduit can oscillate transverse to displacement along said path, and means for imparting the transverse oscillation to said one head and its conduit in the course of displacement along said path.

13. Apparatus according to claim 12, in which jet discharges from each of said heads are over a limited directionally divergent spread involving different angles of jet incidence on the object.

14. Apparatus according to claim 13, in which the directional spread of jets of the oscillated head is less than the directional spread of jets of the other head.

15. Apparatus according to claim 14, in which the oscillated head trails the other head in the course of movement along said predetermined path.

16. Apparatus according to claim 13, in which the spread of jet divergence from said heads is in the range up to 27° with respect to the direction of a central plane of symmetry of erosive action in the course of movement along said path.

17. Apparatus according to claim 13, in which all directions of jet discharge from one of said heads are at different angles of incidence from the directions of jet discharge from the other of said heads.

18. Apparatus according to claim 13, in which coolant supply means is connected for discharge between said rigidly connected heads.

19. Apparatus according to claim 18, in which said coolant supply means includes plural spaced jets in progressively formed divergent directions distributed between said heads.

20. Apparatus according to claim 12, in which said last-defined means comprises a continuously driven eccentric cam reacting against spring-loaded follower action on the cam.

* * * * *